United States Patent [19]

Farquhar et al.

[11] Patent Number: 4,896,141

[45] Date of Patent: Jan. 23, 1990

[54] FIRE AND OVERHEAT DETECTION

[75] Inventors: Robert L. Farquhar, Reading; Brian D. Powell, Maidenhead, both of United Kingdom

[73] Assignee: Graviner Limited, Billericay, England

[21] Appl. No.: 182,106

[22] Filed: Apr. 15, 1988

[30] Foreign Application Priority Data

Apr. 16, 1987 [GB] United Kingdom ..... 8709287

[51] Int. Cl.[4] ..... G08B 17/02; H01J 5/16

[52] U.S. Cl. ..... 340/590; 250/227; 340/508

[58] Field of Search ..... 340/584, 590, 596, 508, 340/509, 522; 374/160-161; 250/227; 350/96.15, 96.2, 96.23; 356/73.1, 44

[56] References Cited

U.S. PATENT DOCUMENTS

| | | | |
|---|---|---|---|
| 4,203,326 | 5/1980 | Gottlieb et al. | 340/584 X |
| 4,453,159 | 6/1984 | Huff et al. | 340/590 |
| 4,650,003 | 3/1987 | Euson | 250/227 X |
| 4,712,096 | 12/1987 | Cholin et al. | 340/590 |

*Primary Examiner*—Glen R. Swann, III
*Assistant Examiner*—Thomas J. Mullen, Jr.
*Attorney, Agent, or Firm*—Leydig, Voit & Mayer

[57] ABSTRACT

An overheat detector comprises an optical fiber connected at one end to a light source and at the other end to a photodiode for monitoring the light level transmitted through the fiber. When the light level falls below a predetermined threshold due to melting of the fiber, an alarm signal is output. The temperature at which the alarm signal is output depends upon the material of which the light conducting part of the fibre is constructed.

11 Claims, 1 Drawing Sheet

FIRE AND OVERHEAT DETECTION

BACKGROUND OF THE INVENTION

The present invention relates to overheat detectors and, more particularly, to such detectors capable of monitoring for overheating in an extensive area.

Systems for detecting overheating and, therefore, the risk of fire are well known. Some of these systems are resettable and can provide an indication of where in the area being monitored, the overheating has taken place. One such system is described in GB-A-2 149 167. However such systems may be considered to be too expensive for some applications. For example, considerable fire risks are associated with fuel storage tanks of the type which have a floating roof, which moves up and down within an outer wall in order to accommodate a variable amount of fuel within the tank. Inevitably a certain amount of fuel vapour will escape between the outer wall and the roof giving rise to a considerable fire risk on the roof of such tanks. Although the roof of such a tank may cover an extremely large area, it is generally not critical to know precisely where overheating has taken place since the required response will be independent of this information. The ability to reset the detector is also not as critical, as for example, in an aircraft, since the detector on a fuel tank roof can be relatively easily replaced, but it is important that large areas should be capable of being monitored at a reasonable cost.

It has been proposed to provide a non-resettable overheat detector consisting of a twisted wire pair, in which the wires are insulated from one another by a matrix, which melts at increased temperatures to allow the wires to come into contact with each other. Such a detector requires a current to flow along one of the wires so that a short caused by the matrix melting in overheat conditions can be detected. Although this detector is relatively cheap to produce, the requirement for there to be an electric potential itself gives rise to an element of fire risk.

The present invention is directed to solving the technical problem of providing an economical overheat detector that does not require the presence of an electric potential and can therefore be made intrinsically safe.

SUMMARY OF THE INVENTION

The present invention accordingly provides an overheat detector comprising an optical fibre, the light conducting part of which melts at a predetermined temperature, means for launching light into one end of the fibre, and means for monitoring the power level of light received at the other end in order to output an alarm signal in dependence on variations in the monitored level indicative of at least the onset of melting of the light conducting part of the optical fibre.

Optical fibres are now available made of plastics material which melt at temperatures of the order of 100°-150° C. In the detector of the invention, the optical fibre will therefore melt if at any point along its length the temperature exceeds this melting point. Once the melting process has begun, the amount of light transmitted will reduce until an alarm signal is generated. Although this type of detector is non-resettable, it is possible to monitor extremely large areas, by using an appropriate length of optical fibre, at a very low cost.

In a preferred embodiment, discriminating means are provided for discriminating between variations in the monitored level due to melting of the light conducting part of the fibre, and variations due to other causes. For example the discriminating means may monitor the variation in time of the received power level, in order to distinguish between an abrupt cut-off due to mechanical breakage and a decay characteristic of melting, in order to inhibit an alarm signal in the event of breakage due to non-overheat conditions.

The invention also provides a method of detecting overheating above a predetermined temperature comprising the steps of disposing an optical fibre around an area to be monitored, the light conducting part of the optical fibre being made of a material which melts at the predetermined temperature, launching light into one end of the fibre, and monitoring the light level received at the other end in order to produce an alarm signal in dependence on the monitored level.

DESCRIPTION OF THE DRAWINGS

An embodiment of an overheat detector in accordance with the invention will now be described, by way of example only, with reference to the accompanying diagrammatic drawings, in which.

DESCRIPTION OF PREFERRED EMBODIMENTS

Figure 1:
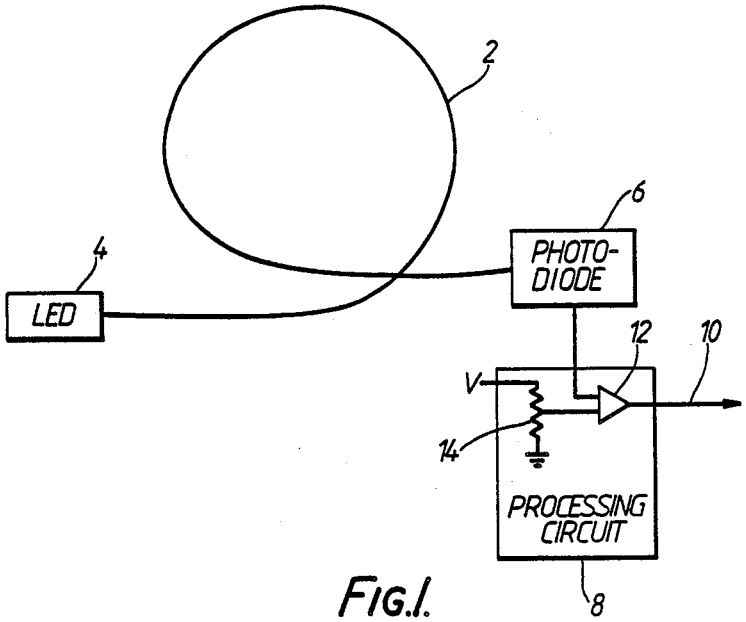
FIG. 1 is a diagrammatic representation of the detector.

An overheat detector comprises a length 2 of plastics optical fibre, one end of which is coupled to a light emitting diode 4 (LED) and the other end of which is coupled to a photodiode 6. The output voltage from the photodiode 6 is fed to a processing circuit 8 which, in appropriate conditions, outputs an alarm signal on output 10.

The particular optical fibre selected depends upon the application of the system and the desired temperature level at which an alarm signal must be produced. A DuPONT CROFON (Trade Mark) fibre has a melting temperature of about 150° C. and exhibits a characteristic variation in the transmitted light level when subjected to temperatures in excess of about 80° C. If temperatures above a higher threshold are to produce an alarm signal, then an appropriate fibre may be selected in accordance with the application.

The optical fibre is housed within a cable to protect it from external mechanical damage, from the weather, and from the entry of extraneous light. The optical fibre 2 is held within the cable under light tension, which is sufficient to separate the two broken ends of a fibre which has melted in order to reduce the possibility of light coupling between the broken ends.

The LED 4 and photodiode 6, which is preferably a silicon diode, are coupled to opposite ends of the fibre in appropriate coupling devices. The output of the photodiode is fed to the processing circuit. In a simple embodiment, the processing circuit is simply a comparator 12. The output of the photodiode 6 is connected to one input of the comparator and reference voltage V is connected to the other input. The output 10 is connected directly to the output of the comparator 12. The reference voltage V is preferably connected to the comparator via a potentiometer 14 so that the processing circuit can be calibrated in dependence upon the length of the optical fibre cable separating the LED 4 and the photodiode 6. The length of optical fibre will necessarily affect the steady state output from the photodiode since there will be a light loss dependent upon the length of the fibre. Typically the output from the photodiode will be of the order of 100–200 mV.

Figure 2:
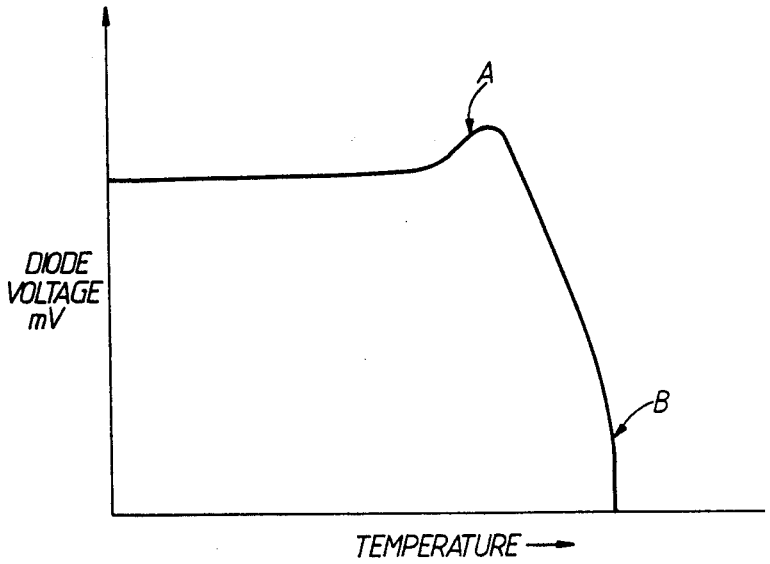
FIG. 2 is a plot of the output of a receiver diode versus temperature.

As shown in FIG. 2, the output from the photodiode 6 exhibits a characteristic variation with temperature. Since the temperature will normally be gradually increasing during overheating, the variation of the diode voltage with time during melting of the optical fibre will vary in a similar fashion to that illustrated in FIG. 2. As shown at A in FIG. 2, there is an initial slight increase in the output from the photodiode due, it is thought, to the annealing of the plastics fibre. This may not take place if a glass fibre were employed. This increase is followed by a gradual decay of the signal level until complete melting takes place at B and the output from the photodiode abruptly reduces to zero at a temperature in excess of the melting temperature of the material from which the light conducting part of the fibre is made. It will be appreciated that if the fibre is broken as a result of being mechanically cut, the level from the photodiode will abruptly fall to zero as the severed ends of the fibre are separated as a result of the tension in the fibre. If the fibre is chafed there will be a gradual decay in the output possibly over a longer time scale and without the initial rise in output characteristic of melting. The processing circuit can take advantage of this distinction in the characteristics of the output from the photodiode as a result of mechanical breakage and melting, in order to differentiate real alarms from false alarms.

In a further modification of the detector, two independent optical fibres are mounted in a single cable. Each fibre is connected to its own LED and photodiode. In this case the processing circuit does not produce an alarm signal on output 10 unless the output level from both photodiodes has fallen below a predetermined threshold. Since simultaneous chafing of both fibres is unlikely, this method will distinguish between melting and either chafing or cutting of one fibre but not cutting of the complete cable. This can be discriminated by measuring the rate of reduction in the output level and inhibiting the alarm if the rate exceeds a preset value.

The cable 2 may also include a metallic conductor in the braiding surrounding the fibre, to which a low potential is applied. The continuity of the cable can thus be monitored by detecting the voltage at the remote end of the fibre. In this case the processing circuit 8 is arranged to produce an alarm only if the photodiode output drops below the predetermined threshold and the monitored voltage from the conducting strands of the sheath exceeds a respective threshold indicating that the cable has not been broken.

In order to reduce the power consumption of the detector the LED may be connected to a pulsed power supply.

The described overheat detector may be used in chemical plants for providing early warning of excess temperature in any stage of the processing so as to prevent thermal runaway. In this case glass fibres may be employed in order to provide threshold temperatures of an appropriate magnitude.

Lengths of optical fibre cable between the LED and photodiode of several hundred meters may be used. If larger areas are to be protected, then it may be necessary to divide them into sections in order to ensure that the level of the photodiode output is of a sufficient magnitude.

What is claimed is:

1. An overheat detector, comprising:

an optical fibre, the light conducting part of which melts at a predetermined temperature, means for launching light into one end of the fibre, and means for monitoring the power level of light received at the other end, in order to output an alarm signal in dependence on variations in the monitored level indicative of interruption of the light conducting part of the optical fibre due to melting of the light conducting part, the monitoring means including discriminating means for discriminating against the production of a said alarm signal in response to abrupt mechanical interruption of the light conducting part, wherein the discriminating means comprises another optical fibre similar to the first mentioned optical fibre, both optical fibres being mounted in a single cable, and means for permitting the output of a said alarm signal only if the monitored power level of the light received from both fibres is below a predetermined threshold.

2. A detector according to claim 1, further comprising means for holding the optical fibre under a sufficient tension to ensure that, upon interruption due to melting, the two portions of the fibre at the point of interruption separate.

3. A detector according to claim 1, wherein the monitoring means comprises a photodiode for converting the received light power level into a related voltage level.

4. An overheat detector, comprising:

an optical fibre, the light conducting part of which melts at a predetermined temperature, means for launching light into one end of the fibre, and means for monitoring the power level of light received at the other end, in order to output an alarm signal in dependence on variations in the monitored level indicative of interruption of the light conducting part of the optical fibre due to melting of the light conducting part, the monitoring means including discriminating means for discriminating against the production of a said alarm signal in response to abrupt mechanical interruption of the light conducting part, wherein the discriminating means monitors the variation in time of the power level in order to distinguish between an initial slight increase therein followed by a gradual decay to zero level characteristic of melting of the light conducting part of the fibre on the one hand and an abrupt fall to zero level characteristic of mechanical interruption of the light conducting part on the other hand.

5. A detector according to claim 4, further comprising means for holding the optical fibre under a sufficient tension to ensure that, upon interruption due to melting, the two portions of the fibre at the point of interruption separate.

6. A detector according to claim 4, wherein the monitoring means comprises a photodiode for converting the received light power level into a related voltage level.

7. An overheat detector, comprising:

an optical fibre, the light conducting part of which melts at a predetermined temperature, means for launching light into one end of the fibre, and means for monitoring the power level of light received at the other end, in order to output an alarm signal in dependence on variations in the monitored level indicative of interruption of the light conducting part of the optical fibre due to melting of the light conducting part, the monitoring means including discriminating means for discriminating against the production of a said alarm signal in response to abrupt mechanical interruption of the light conducting part, wherein the discriminating means comprises a conductor which is connected to an electrical potential at one end and is contained in a cable also containing the optical fibre, and means for monitoring the potential in said conductor at the other end of the cable to inhibit the output of a said alarm signal if the monitored potential indicates a break in the cable.

8. A detector according to claim 7, further comprising means for holding the optical fibre under a sufficient tension to ensure that, upon interruption due to melting, the two portions of the fibre at the point of interruption separate.

9. A detector according to claim 7, wherein the monitoring means comprises a photodiode for converting the received light power level into a related voltage level.

10. A method of detecting overheating above a predetermined temperature, comprising the steps of disposing an optical fibre around an area to be monitored, the light conducting part of the optical fibre being made of a material which melts at the predetermined temperature, launching light into one end of the fibre, and monitoring the variation in time of the received power level of the light received at the other end in order to produce an alarm signal when the fibre melts in response to a said overheating and not to produce an alarm signal when there is an abrupt mechanical breakage or interruption of the fibre, the monitoring step comprising the step of monitoring the variation in time of the power level whereby to distinguish between an initial slight increase in the power level followed by a gradual decay to zero level which is characteristic of the melting of the fibre on the one hand and abrupt cut-off of the power level which is characteristic of said mechanical breakage or interruption of the fibre on the other hand.

11. A method according to claim 10, further comprising the step of holding the optical fibre under a sufficient tension to ensure that, upon interruption due to melting, the two portions of the fibre at the point of interruption separate.

* * * * *